US010159311B2

(12) United States Patent
Cai et al.

(10) Patent No.: US 10,159,311 B2
(45) Date of Patent: Dec. 25, 2018

(54) EMBROIDERED VAMP PROCESS AND VAMP TO WHICH IT IS APPLIED

(71) Applicant: Sincetech (Fujian) Technology Co., Ltd., Jinjiang, Quanzhou, Fujian (CN)

(72) Inventors: Qinglai Cai, Fujian (CN); Weixiong Shi, Fujian (CN); Le Chen, Fujian (CN); Yizhen Cai, Fujian (CN); Fang Lin, Fujian (CN)

(73) Assignee: SINCETECH (FUJIAN) TECHNOLOGY CO., LTD., Fujian (CN)

( * ) Notice: Subject to any disclaimer, the term of this patent is extended or adjusted under 35 U.S.C. 154(b) by 42 days.

(21) Appl. No.: 15/297,890

(22) Filed: Oct. 19, 2016

(65) Prior Publication Data

US 2017/0325547 A1 Nov. 16, 2017

(30) Foreign Application Priority Data

May 13, 2016 (CN) ..... 2016 1 0317514

(51) Int. Cl.

| | |
|---|---|
| ***A43B 23/02*** | (2006.01) |
| ***A43B 7/08*** | (2006.01) |
| ***A43B 23/26*** | (2006.01) |
| ***D05C 7/00*** | (2006.01) |
| ***D05B 15/02*** | (2006.01) |
| ***D05B 37/00*** | (2006.01) |

(52) U.S. Cl.

CPC ..... *A43B 23/026* (2013.01); *A43B 7/085* (2013.01); *A43B 23/025* (2013.01); *A43B 23/0205* (2013.01); *A43B 23/028* (2013.01); *A43B 23/26* (2013.01); *D05B 15/02* (2013.01); *D05B 37/00* (2013.01); *D05C 7/00* (2013.01); *D05D 2305/08* (2013.01)

(58) Field of Classification Search

CPC ..... A43B 23/025; A43B 23/026; A43B 23/04; A43B 7/085

USPC ..... 36/47, 48

See application file for complete search history.

(56) References Cited

U.S. PATENT DOCUMENTS

| | | | | |
|---|---|---|---|---|
| 3,583,081 A * | 6/1971 | Hayashi | A43B 1/14 | 36/45 |
| 4,616,432 A * | 10/1986 | Bunch | A43B 11/00 | 36/114 |
| 2003/0093924 A1* | 5/2003 | Delgorgue | A43B 1/0072 | 36/117.3 |

(Continued)

*Primary Examiner* — Ted Kavanaugh

(74) *Attorney, Agent, or Firm* — Harness, Dickey & Pierce, PLC; Anthony G. Fussner

(57) ABSTRACT

An embroidered vamp process includes the following steps: (1) designing a vamp manufacture drawing by a computer; (2) according to the design drawing of step (1), cutting different pieces of cloth into base fabric of the vamp and a splice component of the vamp respectively by a laser; (3) typesetting the splice component cut in step (2) on the base fabric, then embroidering the splice component on the base fabric according to an embroidery thread pattern of the drawing by an embroidery machine; (4) cutting out the redundant base fabric of the vamp along the edge the splice component by, once again, the laser, forming the vamp of the finished product shoe model. An embroidered vamp comprises a vamp body, said vamp body comprising the base fabric and the splice component, said splice component being embroidered on the surface of base fabric by embroidery thread.

19 Claims, 2 Drawing Sheets

(56) References Cited

U.S. PATENT DOCUMENTS

| | | | | |
|---|---|---|---|---|
| 2006/0112594 | A1* | 6/2006 | Kilgore | A43B 23/0235 36/45 |
| 2007/0266594 | A1* | 11/2007 | Smith | A43B 7/14 36/45 |
| 2008/0271265 | A1* | 11/2008 | Howley | A43D 8/16 12/146 B |
| 2014/0033577 | A1* | 2/2014 | Uda | A43B 9/00 36/25 R |
| 2015/0245686 | A1* | 9/2015 | Cross | A43B 13/02 36/29 |

* cited by examiner

EMBROIDERED VAMP PROCESS AND VAMP TO WHICH IT IS APPLIED

CROSS-REFERENCE TO RELATED APPLICATION

This application claims the benefit and priority of Chinese Invention Patent Application No. 201610317514.9 filed May 13, 2016. The entire disclosure of the above application is incorporated herein by reference.

FIELD

The present invention generally relates to shoes, and more specifically, to an embroidered vamp process and a vamp to which it is applied.

BACKGROUND

This section provides background information related to the present disclosure which is not necessarily prior art.

The early vamp manufacture process is troublesome. It needs to use glue adhesion. The glue adhesion volatilizes and generates poison gas. The poison gas threatens the human health, is prone to pollute the environment, and is not environmentally friendly. The vamp manufactured by adopting the traditional vamp manufacture process may become unglued after it is used for a period of time. The quality is not good. The sense of comfort when wearing is not enough. It cannot meet the people's current needs. Also, the production capacity is low, and the rejection rate is high. Meanwhile, these shoes are not well ventile and rather stiff, and new shoes may even be possible to hurt feet.

SUMMARY

This section provides a general summary of the disclosure, and is not a comprehensive disclosure of its full scope or all of its features.

With respect to shortcomings of the prior art, the present invention provides an embroidered vamp process and a vamp to which it is applied. It can use different shell fabric to perform automated production according to needs. The production has more flexibility. At the same time, connection between a splice component and base fabric is more firm and does not deform easily. Shoes are not stiff when people walk, and they are more comfortable to wear.

In order to achieve the above mentioned object, a technical solution provided by the present invention is an embroidered vamp process comprising the following steps:

(1) designing a vamp manufacture drawing by a computer;

(2) according to the design drawing of step (1), cutting different pieces of cloth into base fabric of the vamp and a splice component of the vamp respectively by a laser;

(3) typesetting the splice component cut in step (2) on the base fabric, then embroidering the splice component of the vamp on the base fabric according to an embroidery thread pattern of the drawing by an embroidery machine;

(4) cutting out the redundant base fabric of the vamp along the edge of the splice component by, once again, the laser, forming the vamp of the finished product shoe model.

Furthermore, an embroidered vamp comprises a vamp body, said vamp body being manufactured by the manufacture method according to claim 1, said vamp body comprising the base fabric and the splice component, said base fabric being a one-piece-cut and half-boat shape which is narrow in the front and is wide in the back, said splice component being embroidered on the surface of base fabric by embroidery thread.

Furthermore, said base fabric is made of warp-knitted spacer fabric, said base fabric comprises a surface layer, a spacer layer and a bottom layer, said spacer layer connects the surface layer and the bottom layer as one piece, the thickness of said spacer layer is 0.1-0.6 cm, said bottom layer is macroporous mesh cloth.

Furthermore, said splice component is made of woven fabric, said splice component comprises shoe side parts and a shoe tip part, said shoe tip part has a ventilation groove, said ventilation groove extends through the surface layer and the spacer layer of base fabric, said ventilation groove has ventilation mesh cloth, the edge of said ventilation mesh cloth is embroidered to the shoe tip part as one piece by embroidery thread.

Furthermore, said shoe side parts have brackets and ventilation holes, said brackets extend from the front end of the shoe side part to the back end of the shoe side part, said brackets are stitched on the surface of the shoe side parts, said brackets are shell fabric which has been heat-setting-processed, said ventilation holes are located on the outer side of brackets, said ventilation holes extend through the upper surface and the lower surface of the vamp body.

Furthermore, the middle part of said vamp body is a shoe tongue part, said shoe tongue part has a U shape, the opening of said shoe tongue part is made up of outwards-convex curved sections.

In comparison with the prior art, the present invention has the following advantageous effects:

1. The present invention simplifies the process flow greatly, increases the production efficiency, and reduces the labor cost at the same time. Also, it can perform the production by using various cloth with different materials and characteristics, according to needs. The production of products has more flexibility, and the connection of the splice component is more firm. The shoes are comfortable when a person wears them.

2. In the present invention, said splice component adopts embroidery thread to reinforce respective components to make them firm, so that the vamp is not easy to deform and is not stiff so as to be worn comfortably when it is used. The splice component is concave and convex in an appropriate way, has a good stereoscopic effect visually, and has a fashionable and esthetic appearance.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Hereinafter, the present invention is further explained in detail in conjunction with the drawings.

Figure 1:
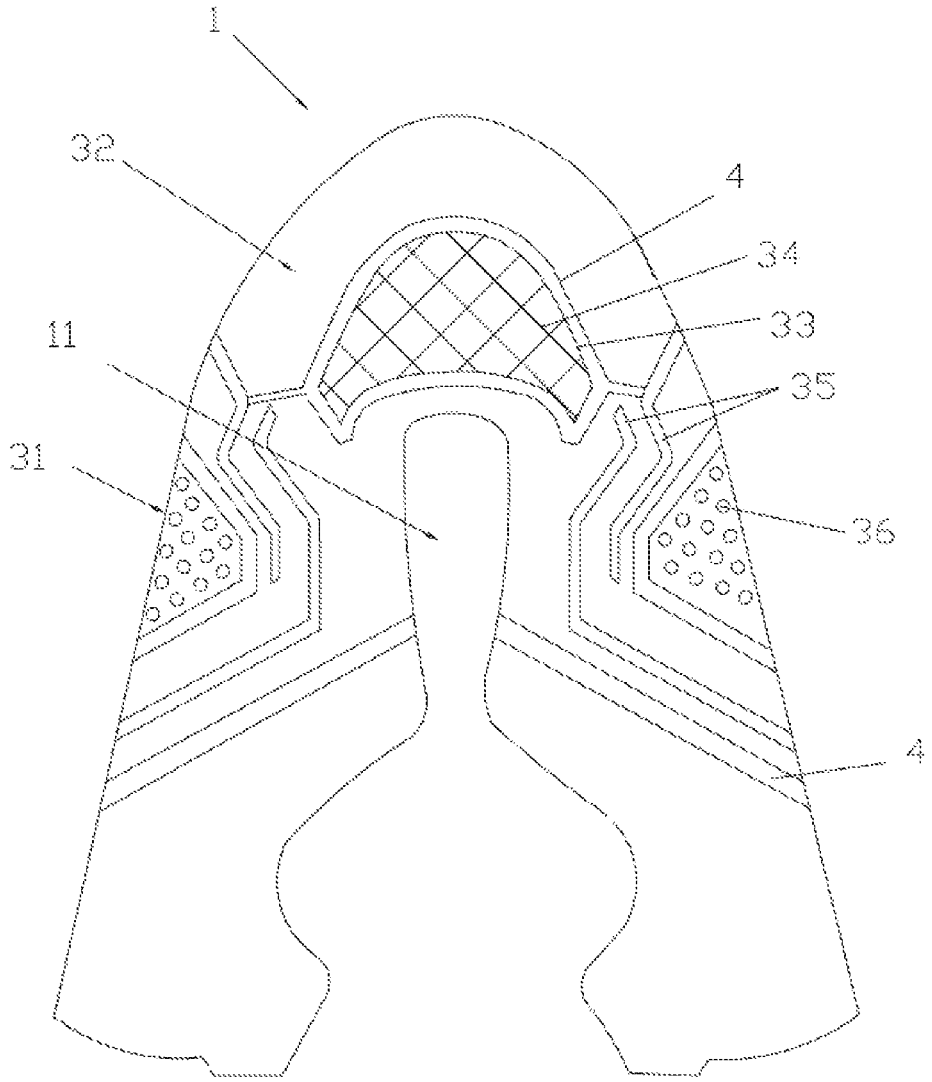
FIG. 1 is a structural diagram according to the present invention.
Figure 2:
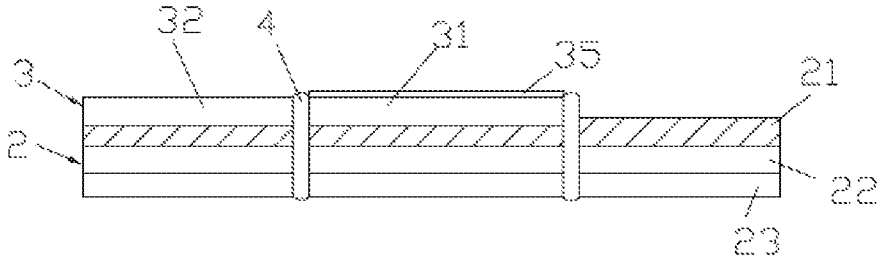
FIG. 2 is a structural diagram of the cross section of FIG. 1 according to the present invention.

As shown in FIGS. 1 and 2, an embroidered vamp process includes the following steps: (1) designing a vamp manufacture drawing by a computer; (2) according to the design drawing of step (1), cutting different pieces of cloth into base fabric 2 of the vamp and a splice component 3 of the vamp respectively by a laser; (3) typesetting the splice component 3 cut in step (2) on the base fabric 2, then embroidering the splice component 3 of the vamp on the base fabric 2 according to an embroidery thread pattern of the drawing by an embroidery machine; (4) cutting out the redundant base fabric 2 of the vamp along the edge of the splice component 3 by, once again, the laser, forming the vamp of the finished product shoe model.

The present invention simplifies the process flow greatly, increases the production efficiency, and reduces the labor cost at the same time. Also, it can perform the production by using various cloth with different materials and characteristics, according to needs. The production of products has more flexibility, and the connection of the splice component 3 is more firm. The shoes are comfortable when a person wears them.

An embroidered vamp includes a vamp body 1, the middle part of said vamp body 1 is a shoe tongue part 11, said shoe tongue part 11 has a U shape, the opening of said shoe tongue part 11 is made up of outwards-convex curved sections, the arc line is more aesthetic. It can be stitched with a shoe tongue conveniently later.

Said vamp body 1 includes base fabric 2 and a splice component 3, said base fabric 2 is an one-piece-cut and half-boat shape which is narrow in the front and is wide in the back, said splice component 3 is embroidered on the surface of base fabric 2 by embroidery thread 4. Said base fabric 2 is made of warp-knitted spacer fabric, said base fabric 2 includes a surface layer 21, a spacer layer 22 and a bottom layer 23, said spacer layer 22 connects the surface layer 21 and the bottom layer 23 as one piece, the thickness of said spacer layer 22 is 0.1-0.6 cm, said bottom layer 23 is macroporous mesh cloth. Said base fabric 2 is one-piece-cut warp knitted spacer fabric, enhances the integrity of the vamp body 1 greatly, so that it is not easy to deform. At the same time, it has good resilience, so that it can protect feet well. It is well ventile and comfortable when wearing it.

Said splice component 3 is made of woven fabric, said splice component 3 includes shoe side parts 31 and a shoe tip part 32, the edge of said splice component 3 is embroidered on the base fabric 2 by embroidery thread 4, said splice component 3 adopts embroidery thread 4 to reinforce respective components to make them firm, so that the vamp is not easy to deform and is not stiff so as to be worn comfortably when it is used. The splice component 3 is concave and convex in an appropriate way, has a good stereoscopic effect visually, and has a fashionable and esthetic appearance.

Said shoe tip part 32 has a ventilation groove 33, said ventilation groove 33 extends through the surface layer 21 and the spacer layer 22 of the base fabric 2, said ventilation groove 33 has ventilation mesh cloth 34, the edge of said ventilation mesh cloth 34 is embroidered to the shoe tip part 32 as one piece by embroidery thread 4. Said shoe side parts 31 have brackets 35 and ventilation holes 36, said brackets 35 extend from the front end of the shoe side parts 31 to the back end the shoe side parts 31, said brackets 35 are stitched on the surface of the shoe side parts 31, said brackets 35 are shell fabric which has been heat-setting-processed, said ventilation holes 36 are located on the outer side of brackets 35, said ventilation holes 36 extend through the upper surface and the lower surface of the vamp body 1. Said brackets 35 are heat-setting-processed, so that internal stress generated by fabric fibers during the tension procedure is eliminated, macromolecules are relaxed to a certain degree, the shape of brackets 35 is fixed to a certain shape, a deformable part of the shoe side parts 31 have brackets 35 to fix the shape of the vamp body 1 better, shoes are comfortable when people wear them.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations in use or operation in addition to the orientation depicted in the figures. For example, if figures are turned over, elements described as "below" or "beneath" other elements or features would then be oriented "above" the other elements or features. Thus, the example term "below" can encompass both an orientation of above and below. An exemplary embodiment may be otherwise oriented (rotated 90 degrees or at other orientations) and the spatially relative descriptors used herein interpreted accordingly.

Finally, it is to be explained that, the above embodiments are only used to explain the technical solutions of the present invention, but not to limit the present invention. Although the present invention is explained in detail with reference to preferred embodiments, those ordinary skilled in the art should understand that, without departing from the spirit and the scope of the technical solutions of the present invention, modifications or equivalent substitutions may be made to the technical solutions of the present invention, which are to be covered by the scope of the claims of the present invention.

The invention claimed is:

1. An embroidered vamp comprising a vamp body, said vamp body comprising a base fabric and a splice component, said base fabric being a one-piece-cut and half-boat shape which is narrow in a front and is wide in a back, said splice component being embroidered on a surface of the base fabric by embroidery thread, wherein:

the base fabric comprises a surface layer, a spacer layer and a bottom layer;

the spacer layer connects the surface layer and the bottom layer;

the splice component comprises one or more shoe side parts and a shoe tip part;

the shoe tip part has a ventilation opening;

the ventilation opening extends through the surface layer and the spacer layer of the base fabric; and the ventilation opening includes ventilation mesh cloth having an edge embroidered to the shoe tip part by embroidery thread.

2. An embroidered vamp process for manufacturing the vamp according to claim 1, the embroidered vamp process comprising the following steps:

(1) designing a vamp manufacture drawing by a computer;

(2) according to the design drawing of step (1), cutting different pieces of cloth into the base fabric of the vamp and the splice component of the vamp respectively by a laser;

(3) typesetting the splice component cut in step (2) on the base fabric, then embroidering the splice component of the vamp on the base fabric according to an embroidery thread pattern of the drawing by an embroidery machine; and (4) cutting out the redundant base fabric of the vamp along an edge of the splice component by, once again, the laser, forming the vamp of a finished product shoe model.

3. The embroidered vamp according to claim 1, wherein:

said spacer layer connects the surface layer and the bottom layer as one piece; the thickness of said spacer layer is 0.1-0.6 cm; and said bottom layer is macroporous mesh cloth.

4. The embroidered vamp according to claim 1, wherein:

a middle part of said vamp body includes a shoe tongue part opening;

a perimeter of said shoe tongue part opening has a U shape; and the shoe tongue part opening is made up of outwards-convex curved sections.

5. The embroidered vamp according to claim 1, wherein:

the base fabric comprises warp-knitted spacer fabric; and the splice component comprises woven fabric.

6. The embroider vamp according to claim 5, wherein the woven fabric of the splice component is attached to a surface of the warp-knitted spacer fabric of the base fabric by the embroidery thread without glue adhesion.

7. The embroidered vamp according to claim 5, wherein:

the warp-knitted spacer fabric of the base fabric is resilient and enhances integrity of the vamp body such that the vamp body is less easy to deform; and the embroidery thread provides reinforcement such that the embroidered vamp is less easy to deform.

8. The embroidered vamp according to claim 1, wherein:

the bottom layer comprises macroporous mesh cloth;

the splice component comprises woven fabric the shoe tip part has a ventilation opening.

9. The embroidered vamp according to claim 8, wherein:

the shoe side parts include ventilation holes and fabric stitched on the surface of the shoe side parts such that the fabric extends from a front end of the shoe side parts to a back end of the shoe side parts;

the ventilation holes are located on an outer side of the fabric; and the ventilation holes extend through an upper surface and a lower surface of the vamp body.

10. The embroidered vamp according to claim 1, wherein the splice component is attached to the base fabric by the embroidery thread without glue adhesion.

11. The embroidered vamp according to claim 10, wherein the embroidery thread and the splice component reinforce the base fabric and make the embroidered vamp less easy to deform.

12. The embroidered vamp according to claim 1, wherein:

the shoe side parts include ventilation holes and fabric stitched on the surface of the shoe side parts such that the fabric extends from a front end of the shoe side parts to a back end of the shoe side parts;

the ventilation holes are located on an outer side of the fabric; and the ventilation holes extend through an upper surface and a lower surface of the vamp body.

13. An embroidered vamp comprising a vamp body, said vamp body comprising a base fabric and a splice component, said base fabric being a one-piece-cut and half-boat shape which is narrow in a front and is wide in a back, said splice component being embroidered on a surface of the base fabric by embroidery thread, wherein:

said base fabric comprises a surface layer, a spacer layer and a bottom layer;

said spacer layer connects the surface layer and the bottom layer as one piece;

the thickness of said spacer layer is 0.1-0.6 cm;

said bottom layer is macroporous mesh cloth;

said splice component is made of woven fabric;

said splice component comprises one or more shoe side parts and a shoe tip part;

said shoe tip part has a ventilation opening;

said ventilation opening extends through the surface layer and the spacer layer of said base fabric;

said ventilation opening has ventilation mesh cloth; and an edge of said ventilation mesh cloth is embroidered to the shoe tip part as one piece by embroidery thread.

14. The embroidered vamp according to claim 13, wherein:

said shoe side parts have ventilation holes and fabric stitched on a surface of the shoe side parts such that the fabric extends from a front end of the shoe side parts to a back end of the shoe side parts;

said ventilation holes are located on an outer side of the fabric; and said ventilation holes extend through an upper surface and a lower surface of the vamp body.

15. An embroidered vamp comprising a vamp body, the vamp body comprising a base fabric and a splice component, the splice component being embroidered on a surface of the base fabric by embroidery thread, wherein:

the base fabric comprises a surface layer, a spacer layer and a bottom layer;

the spacer layer connects the surface layer and the bottom layer;

the splice component comprises one or more shoe side parts and a shoe tip part;

the shoe tip part has a ventilation opening;

the ventilation opening extends through the surface layer and the spacer layer of the base fabric; and the ventilation opening includes ventilation mesh cloth having an edge embroidered to the shoe tip part by embroidery thread.

16. The embroidered vamp according to claim 15, wherein:

the shoe side parts include ventilation holes and fabric stitched on the surface of the shoe side parts such that the fabric extends from a front end of the shoe side parts to a back end of the shoe side parts;

the ventilation holes are located on an outer side of the fabric; and the ventilation holes extend through an upper surface and a lower surface of the vamp body.

17. The embroidered vamp according to claim 15, wherein:

the bottom layer of the base fabric comprises macroporous mesh cloth; and the splice component comprises woven fabric.

18. The embroidered vamp according to claim 15, wherein:

the embroidery thread and the splice component reinforce the base fabric and make the embroidered vamp less easy to deform; and the splice component is attached to the base fabric by the embroidery thread without glue adhesion.

19. The embroidered vamp according to claim 15, wherein the shoe side parts include fabric stitched on a surface of the shoe side parts such that the fabric extends from a front end of the shoe side parts to a back end of the shoe side parts, which fabric has been heat set into a fixed certain shape.

* * * * *